United States Patent [19]

Finnern

[11] 4,455,718

[45] Jun. 26, 1984

[54] SCUBA TANK WEIGHT STRAP

[75] Inventor: David L. Finnern, Costa Mesa, Calif.

[73] Assignee: Joseph J. Ryan, Costa Mesa, Calif. ; a part interest

[21] Appl. No.: 348,351

[22] Filed: Feb. 12, 1982

[51] Int. Cl.[3] ..... A44B 11/00; B63L 11/02

[52] U.S. Cl. ..... 405/186; 24/33 P; 24/573; 2/2.1 R; 114/315

[58] Field of Search ..... 405/185, 186, 187; 2/2.1 R; 128/202.14; 24/33 P, 201 LD, 204; 114/315; 441/96, 123; D2/311

[56] References Cited

U.S. PATENT DOCUMENTS

| | | | |
|---|---|---|---|
| 2,272,527 | 2/1942 | Koester | 24/33 P |
| 3,034,596 | 5/1962 | Twaits | 2/2.1 R |
| 3,470,570 | 10/1969 | Christiansen | 405/186 |
| 3,808,824 | 4/1974 | Johnston et al. | 405/186 |
| 3,967,459 | 7/1976 | Dewis | 405/186 |

*Primary Examiner*—Gene Mancene
*Assistant Examiner*—John G. Weiss
*Attorney, Agent, or Firm*—Hubbard & Stetina

[57] ABSTRACT

A weight strap adapted to be mounted circumferentially about the scuba tank of a diver is disclosed which is specifically designed to permit rapid jettisonning of the same in an emergency situation. The weight strap of the present invention is formed to utilize conventional lead diving weights and includes a resilient strap portion designed to provide tension within the strap and tightly maintain the weight strap about the scuba tank. Opposite ends of the strap are provided with a pair of mating, quick release connectors which by way of a single manual motion, may be separated from one another to selectively release the weight strap from the scuba tank.

14 Claims, 3 Drawing Figures

SCUBA TANK WEIGHT STRAP

BACKGROUND OF THE PRESENT INVENTION

The present invention relates to scuba diving gear and more particularly, to a scuba weight strap which may be mounted circumferentially about the scuba tank of a diver.

As is well known, in order to compensate for the natural buoyancy of a diver and the buoyancy of the wet suit typically worn by the diver, it is necessary during a diving application to utilize a weight system to permit the diver to remain submerged at the desired diving depths. Basically, two types of weight systems have been utilized in the prior art, the first comprising a weight belt securable about the waist of the diver and adapted to carry one or more lead weights thereon, and the second comprising a lead shot filled pouch or pack mountable to the scuba tank harness and positioned about the lower back of the diver. Although both of these prior art weight systems have proven suitable in general diving applications, they possess inherent deficiencies which detract from their overall effectiveness.

The weight belt system, the most commonly utilized in the prior art, has proven to be excessively restrictive to divers due to its position about the waist of the diver. In addition, the majority of such prior art weight belts have been attached to the diver by way of a buckle and strap arrangement, which oftentimes is difficult to fasten or remove from the diver's waist. Further, in view of other diving gear, such as a buoyancy compensator and compressed air tank harness being similarly attached about the user's waist, the use of such prior art weight belts has posed a significant safety hazard; since in an emergency situation, the diver may inadvertently jettison the air tank and or buoyance compensator strap rather than the weight belt itself.

The prior art backpack shot systems, although typically providing a more viable jettisonning mechanism have generally been comparatively expensive and have typically required a particular tank/backpack harness system to be purchased and utilized by the diver. In addition, the use of the lead shots in such systems rather than conventional lead belt weights, has proven inconvenient, typically requiring the diver to transport the heavy weight shots to the desired diving location rather than permitting rental of the weights from on-site commercial diving establishments.

Hence, there exists a substantial need in the art for a low-cost weight system which utilizes conventional lead weights, functions without unduly restricting the diver's motion, and permits rapid and safe-guarded jettisonning of the weight system in an emergency situation.

SUMMARY OF THE PRESENT INVENTION

The present invention specifically addresses and alleviates the above-referenced deficiencies associated in the prior art by providing an improved weight system which may be positioned and maintained in a circumferential orientation about the compressed air tank of the scuba diver. More particularly, the weight strap of the present invention comprises an elongate strap member which is adapted to receive one or more conventional lead weights. Opposite ends of the strap member are provided with a pair of mating, quick-release cnonectors which when attached together, mount the weight strap about the tank of the diver; and when desired to jettison the weight strap, may be rapidly disconnected from one another in a single manual motion to release the weight strap from the air tank. The intermediate portion of the elongate strap member is additionally provided with an resilient, stretchable section adapted to be placed in moderate tension when the weight strap is attached to the tank and thereby securely maintain the weight strap in a desired location upon the tank.

Due to the weight strap of the present invention being positioned circumferentially about the compressed air tank, the diver's freedom of motion is not impaired or restricted as with the prior art waist belt systems, and further, the weight strap may be conveniently stored directly upon the compressed air tank when not in use. In addition, the use of the quick-release fasteners in combination with the tank mounting location of the weight strap of the present invention, permits the rapid jettisonning of the same in an emergency situation without the possibility of releasing the other diving gear from the diver.

Further, the tank weight strap of the present invention may be manufactured at relatively low-cost, and utilize conventional lead weights which permits the user to merely rent lead weights at the desired diving location rather than transporting the same to the diving location.

DESCRIPTION OF THE DRAWINGS

These as well as other features of the present invention become more apparent upon reference to the drawings wherein.

DETAILED DESCRIPTION OF THE PREFERRED EMBODIMENT

Figure 1:
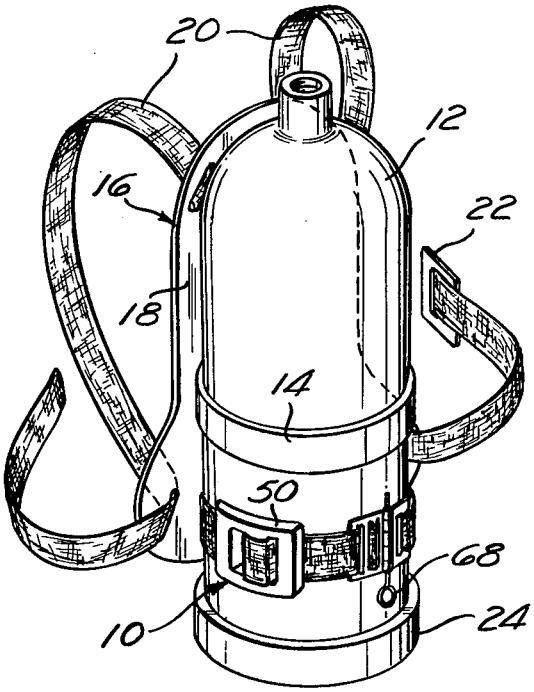
FIG. 1 is a perspective view of a conventional scuba tank and harness assembly depicting the tank weight strap of the present invention and its preferred location upon the tank.

Referring to FIG. 1, there is shown the tank weight strap 10 of the present invention disposed about a conventional scuba tank 12 (i.e., a compressed air tank). As is well known, the tank 12 is typically mounted as by way of a stainless steel ring 14 to a tank harness 16, composed of a semi-rigid back plate 18 and a pair of straps 20. When worn about the user (not shown) the plate 18 and tank 12 are positioned about the back of the user and maintained by the pair of straps 20 which extend about the shoulders of the user and are fastened together about the waist of the user as by way of a buckle 22. As is well known, a regulator and air hose mouth piece assembly (not shown) is mounted to the tank 12 to provide breathable air to the user in the diving application. The tank weight strap 10 of the present invention is preferably positioned in a circumferential orientation about the lower portion of the tank 12, between the stainless steel tank mount ring 14 and tank protective end cap 24.

Figure 2:
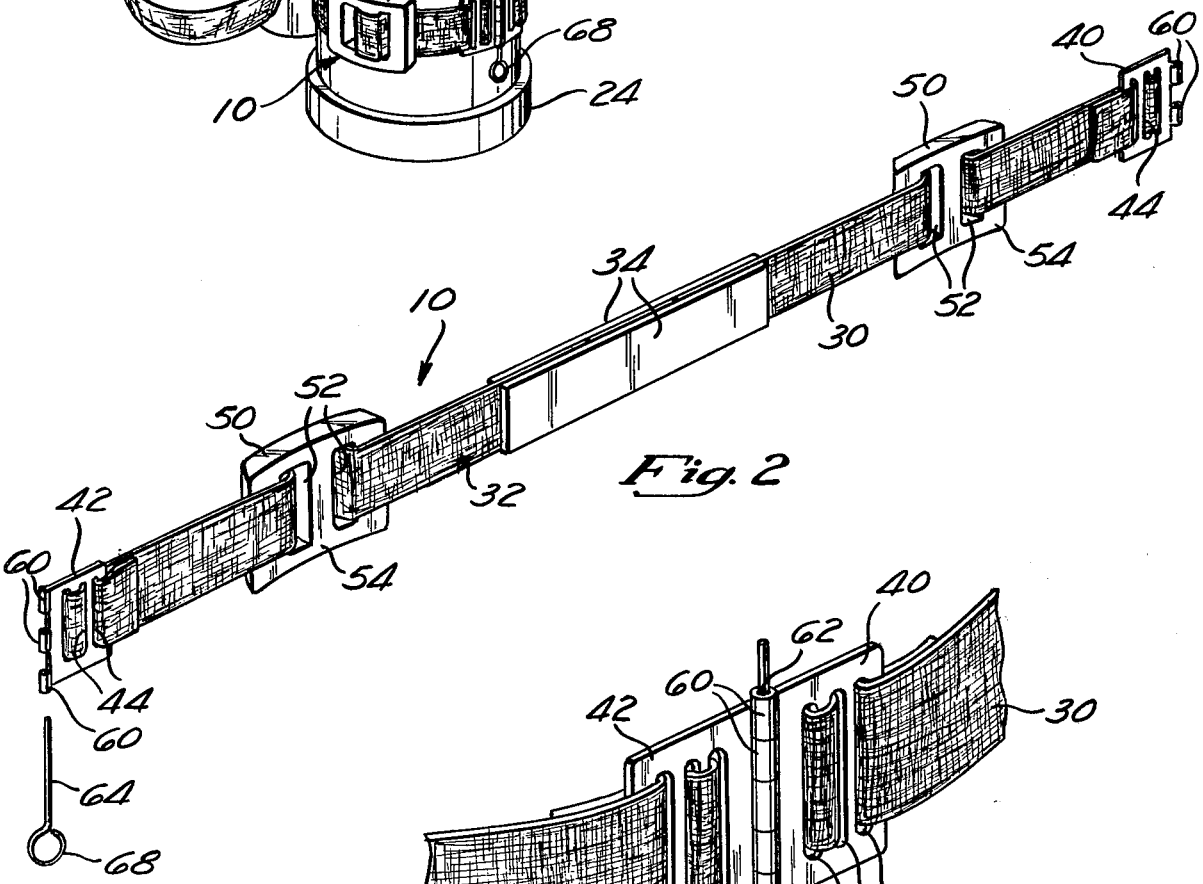
FIG. 2 is a perspective view of the tank weight strap of the present invention removed from the air tank; illustrating its detailed construction and the manner in which conventional lead weights may be carried thereon.

Referring to FIG. 2, the detailed construction of the tank weight belt 10 of the present invention may be described. As shown, the strap 10 is formed from a pair of elongate strap members 30 and 32 preferably fabricated from a nylon-weave fabric material having a width of approximately 2 inches. Adjacent ends of the elongate strap members 30 and 32 are rigidly connected as by way of adhesive and/or stitching to an intermediate strap portion 34 composed of a resilient material such as rubber. As will become more apparent infra, the intermediate or central strap portion 34 is adapted to be stretched when the tank weight strap 10 is mounted about the air tank 12, to generate a moderate tensile force within the strap 10 which securely maintains the strap 10 in position about the tank 12.

The opposite distal ends of the elongate strap members 30 and 32 are provided with a pair of end connectors 40 and 42 respectively which are preferably formed from a resistant material such as stainless steel or plastic. The connectors 40 and 42 are adjustably secured to the strap members 30 and 32 by weaving the ends of the strap members 30 and 32 through the plural slot-like apertures formed in the end connectors 40 and 42. In a similar manner, conventional lead weights 50 may be positioned upon the elongate strap members 30 and 32 by weaving the strap members 30 and 32 through the slot-like apertures 52 formed in the lead weights 50. Those skilled in the art will recognize that although for illustration purposes, only two lead weights 50 have been depicted upon the strap portions 30 and 32, fewer or additional weights 50 may be positioned thereon to accommodate the particular diver and diving application. In addition, although in the preferred embodiment, the lead weights 50 comprise conventional hip weights which include a slight concave inner surface 54 which approximates the curvature of the air tank 12, other conventional flat lead weights may be readily accommodated upon the strap sections 30 and 32 of the present invention.

Figure 3:
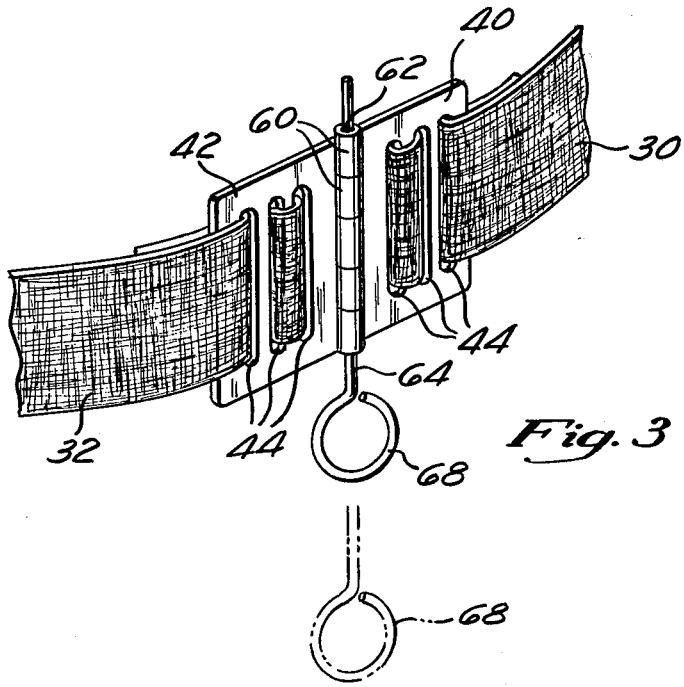
FIG. 3 is an enlarged partial perspective view of the quick-release connectors of the tank weight strap of the present invention, illustrating the manner in which the tank weight strap may be rapidly jettisoned by the diver in an emergency situation.

Referring to FIG. 3, it may be seen that the end connectors 40 and 42 are formed in a complimentary mating, hinged-like configuration having plural barrel members 60 formed on their distal ends. The inside diameters 62 of each of the barrel members 60 is sized to be slightly greater than the outside diameter of an elongate pull pin 64 such that when the end connectors 40 and 42 are desired to be connected together, the barrel members 60 on each of the end connectors 40 and 42 may be vertically aligned and the pull pin 64 may be inserted vertically therethrough. As will be recognized, due to the end connectors 40 and 42 being freely pivotal about the pull pin 64, when positioned about the air tank 12, the end connectors 40 and 42 pivotally conform to and may approximate the diameter of the compressed air tank 12.

With the structure defined, the mounting and operation of the tank weight strap 10 of the present invention may be described. Initially, the user must determine the amount of weight desired for the particular diving application and attach one or more conventional lead weights 50 upon the elongate strap members 30 and 32 in the manner previously described. The tank weight strap 10 may subsequently be preliminarily positioned about the lower portion of the tank 12, between the tank mounting ring 14 and tank end cap 24. Positioned in such a manner, the length of the strap portions 30 and 32 may be adjusted to accommodate the particular circumference size of the tank 12 by threading or weaving the distal ends of the strap members 30 and 32 through the end connectors 40 and 42 respectively, such that the overall length of the tank weight strap 10 is slightly less than the circumference of the air tank 12 (i.e., approximately a quarter to one-half inch). The end connectors 40 and 42 may then be pulled about the circumference of the air tank 12 causing the resilient member portion 34 of the tank weight strap 10 to moderately stretch and the barrel portions 60 of the end connectors 40 and 42 may be intermeshed and vertically aligned as depicted in FIG. 3. The user subsequently inserts the elongate pull pin 64 into the aligned apertures 62 of the barrel members 60, thereby pivotally interconnecting the end connectors 40 and 42 together. Due to the moderate stretching of the intermediate strap portion 34, a tensile force is generated within the weight strap 10 which simultaneously applies a shear force through the barrel sections 60 to the elongate pull pin 64 thereby causing the pin 64 to be retained in position. Additionally, due to the tensile force generated by the resilient intermediate strap portion 34, the tank weight strap 10 along with the lead weights 50 are maintained in the desired position upon the compressed air tank 12. Hence, the diver may subsequently fasten the tank harness assembly 16 about his body, and utilize the tank weight strap 10 in an actual diving application without restricting his freedom of motion.

When it is desired to release the tank weight belt 10 from the compressed air tank 12, as upon confronting an emergency diving situation, the diver may simply reach behind his back and grasp the circular handle portion 68 of the elongate pin 64; and in single downward motion, overcome the shear force acting to retain the pin 64 in position and pull the elongate pin 64 downward out of engagement with the barrel members 60. Upon removal of the pull pin 64 from the barrel members 60, the tensile force exerted by the intermediate strap portion 34 causes the end connectors 40 and 42 to rapidly separate from one another wherein the entire tank weight strap 10 along with the lead weights 50 is released from the circumference of the tank 12 and rapidly jettisoned. Those skilled in the art will recognize that due to the pull pin 64 being located directly upon the compressed air tank 12 rather than about the waist of the diver, the single downward manual release movement of the pull pin 64 insures that only the tank weight strap 10 is jettisoned and not the other diving gear such as the tank harness 16 and/or buoyancy compensator (not shown). Thus, the present invention renders a significant improvement to the art by providing a relatively low-cost weight system which is specifically adapted to permit unrestricted diver motion and the jettisoning of the weight strap in an emergency diving situation.

Those skilled in the art will recognize that although in the preferred embodiment particular materials and sizes have been specified herein, modifications to the same may be readily accomplished without departing from the spirit of the present invention; and such modifications are clearly contemplated herein.

What is claimed is:

1. An air tank weight strap system for use in scuba diving applications, comprising:

a scuba air tank adapted to hold a quantity of breathable air;

at least one conventional diving weight having an aperture extending therethrough;

an elongate flexible strap sized to be positioned and extend about the circumference of said scuba air tank and be inserted through the aperture formed in said at least one weight to carry said at least one weight thereon, said elongate strap comprising a pair of end strap portions and an intermediate strap portion, said intermediate strap portion formed of a resilient material adapted to provide continuous tension in said strap to tightly maintain said strap about the circumference of said air tank;

a pair of fastening members comprising a mating hinge, each of said fastening members being mounted to said strap adjacent opposite ends of said strap and adapted to be interconnected to retain said strap about the circumference of said scuba air tank; and means for selectively interconnecting said pair of fastening members to permit said elongate strap to be rapidly released from said scuba tank.

2. The weight strap system of claim 1 wherein said interconnecting means comprises an elongate member insertable within said mating hinge to form a pivot axis for said mating hinge.

3. The weight strap system of claim 2 wherein said elongate member is adapted to be manually withdrawn from said mating hinge in a single manual motion.

4. The weight strap system of claim 3 wherein said pair of end portions are formed of a nylon weave material.

5. The weight strap system of claim 4 wherein said mating hinge and said elongate member are formed of a corrosion resistant material.

6. The weight strap system of claim 5 wherein said corrosion resistant material is stainless steel.

7. The weight strap system of claim 6 wherein said intermediate portion is formed of an elastomeric material.

8. An air tank weight strap system for use in scuba diving application, comprising:

a scuba air tank adapted to hold a quantity of breathable air;

at least one conventional diving weight having an aperture extending therethrough;

an elongate flexible strap sized for positioning and extending about the circumference of said scuba air tank and for insertion through the aperture formed in said at least one weight to carry the weight thereon;

a pair of fastening members comprising a mating hinge, each of said fastening members being mounted to said strap adjacent opposite ends of said strap and adapted to be interconnected to retain said strap about the circumference of said scuba air tank; and means for selectively interconnecting said pair of fastening members to permit said elongate strap to be rapidly released from said scuba tank.

9. The weight strap system of claim 8 wherein said interconnecting means comprises an elongate member insertable within said mating hinge to form a pivot axis for said mating hinge.

10. The weight strap system of claim 9 wherein said elongate member is adapted to be manually withdrawn from said mating hinge in a single manual motion.

11. The weight strap system of claim 10 wherein said pair of end portions are formed of a nylon weave material.

12. The weight strap system of claim 11 wherein said mating hinge and said elongate member are formed of a corrosion resistant material.

13. The weight strap system of claim 12 wherein said corrosion resistant material is stainless steel.

14. The weight strap system of claim 13 wherein said intermediate portion is formed of an elastomeric material.

* * * * *